US012326051B2

(12) United States Patent
Strohla

(10) Patent No.: US 12,326,051 B2
(45) Date of Patent: Jun. 10, 2025

(54) SPRING RETURN SYSTEM

(71) Applicant: Halliburton Energy Services, Inc., Houston, TX (US)

(72) Inventor: Nick Strohla, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/453,942

(22) Filed: Aug. 22, 2023

(65) Prior Publication Data

US 2025/0067137 A1 Feb. 27, 2025

(51) Int. Cl.
*E21B 23/00* (2006.01)

(52) U.S. Cl.
CPC ..... *E21B 23/006* (2013.01)

(58) Field of Classification Search
CPC ..... E21B 17/00; E21B 17/22; E21B 23/00; E21B 41/00
See application file for complete search history.

(56) References Cited

U.S. PATENT DOCUMENTS 4,047,853 A * 9/1977 Huckaby ..... F04B 53/04 417/434
5,669,457 A 9/1997 Sebastian et al.
2003/0188861 A1* 10/2003 Doyle ..... E21B 23/01 166/241.1
2008/0041583 A1 2/2008 Angman et al.
2012/0285686 A1* 11/2012 Xu ..... E21B 31/005 166/301
2017/0234081 A1 8/2017 Kirkhope
2021/0087890 A1 3/2021 Dinica et al.
2023/0175326 A1 6/2023 Vass et al.

FOREIGN PATENT DOCUMENTS

EP 2846857 3/2016
JP 2000131184 5/2000

OTHER PUBLICATIONS

"PCT Application No. PCT/US2023/072770, International Search Report and Written Opinion", Apr. 30, 2024, 10 pages.

* cited by examiner

*Primary Examiner* — Tara Schimpf
*Assistant Examiner* — Lamia Quaim
(74) *Attorney, Agent, or Firm* — DeLizio, Peacock, Lewin & Guerra LLP

(57) ABSTRACT

An apparatus to be positioned in a wellbore formed in a subsurface formation. The apparatus comprises a first lug coupled with a rotation component and configured to rotate a first angle from a neutral position about a central axis when a rotational force is applied to the first lug via the rotation component. The apparatus comprises first bias component coupled with the first lug and configured to return the first lug to the neutral position when the first lug is rotated about the central axis.

20 Claims, 9 Drawing Sheets

SPRING RETURN SYSTEM

FIELD

Implementations of the inventive subject matter relate generally to the field of rotating downhole wellbore tools and more particularly to the field of a spring return system for a rotating downhole wellbore tool.

BACKGROUND

In hydrocarbon recovery operations, tools deployed in a wellbore formed in a subsurface formation may rotate about a central axis. The tool may naturally rotate when deploying in the wellbore and/or the tool may be controlled (such as by a control line, motor, etc.) to rotate mechanically. For example, a tool may need to rotate about a central axis to be properly oriented in order to establish a connection with another tool in a wellbore. Due to the nature of the wellbore and/or tools, the tools may not be properly oriented when first deployed in the wellbore, resulting in the need to rotate at least one of the tools to properly orient the tool to establish a connection. The process of connecting and disconnecting tools may need to be repeated multiple times, resulting in the reorienting of the tool each time a connection needs to be reestablished. Therefore, there is a need for mechanisms that facilitate rotating or otherwise orienting tools in a wellbore.

BRIEF DESCRIPTION OF THE DRAWINGS

Embodiments of the disclosure may be better understood by referencing the accompanying drawings.

DESCRIPTION

Figure 1A:
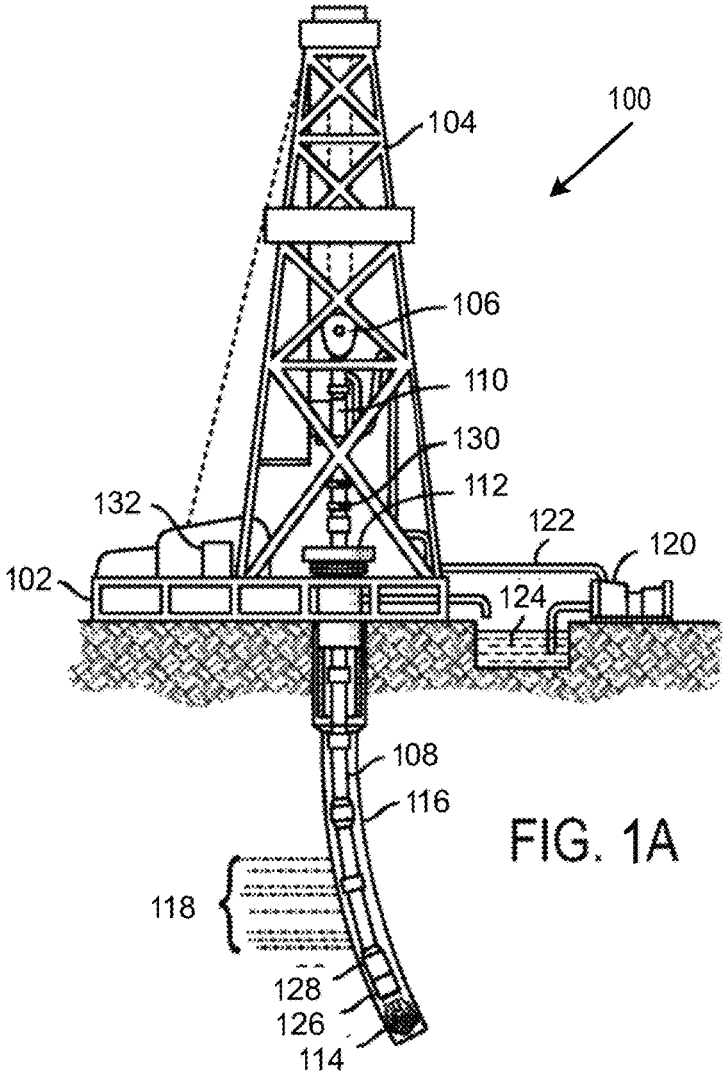
FIGS. 1A-1B are schematics of exemplary systems for a downhole tool, according to some implementations.

The description that follows includes example systems, methods, techniques, and program flows that embody aspects of the disclosure. However, it is understood that this disclosure may be practiced without these specific details. For instance, this disclosure refers to a lug assembly comprising one or more lugs and bias components that may be configured to return a rotation component to a neutral position. Aspects of this disclosure may also be applied to any other configuration of components in the lug assembly to return the rotation component to a neutral position. For clarity, some well-known instruction instances, protocols, structures, and techniques may be omitted.

Example implementations relate to a lug system that returns a rotation component back to a neutral position. In some implementations, a tool deployed in a wellbore formed in a subsurface formation may rotate about its respective central axis. For example, a tool may need to rotate to be properly oriented to establish a connection with another tool positioned in the wellbore. In some implementations, components of the tool may twist and/or break when rotated. For example, the tool may include a fiber optic cable that is unable to rotate without losing functionality. Alternatively, or in addition to, the tool may need to return to its neutral position (the original position before rotating) when disconnected from the other tool in the wellbore.

In some implementations, a lug system may be utilized to return the rotation component, that has rotated, back to a neutral position without any components moving axially up and/or down the wellbore. In some implementations, the lug system may include one or more lugs with one or more corresponding bias components positioned in between each of the lugs. The bias components may include one or more torsion spring, compression spring, tension spring, etc. In some implementations, each lug may be utilized as a torsion rod. A lug may be coupled with a rotation component that, when rotated about a central axis of the tool, may apply a rotational force to the lug, resulting in the lug rotating an angle from the neutral position about the central axis. Alternatively, when the lug returns back to a neutral position, the rotation component may also return back to the neutral position. In some implementations, the bias component coupled with the lug may be bias towards the neutral position such that the bias component may return the lug (and subsequently the rotation component) back to the neutral position when the rotation force is less than the bias component force of the bias component. For example, a downhole tool may be deployed in a wellbore to connect with another tool. The downhole tool may include a lug system and a rotation component that may rotate to orient to a position to establish a connection with the other tool. The rotation component of the downhole tool may rotate about the downhole tool's central axis. The rotational force of the rotation component may result in one or more lugs of the lug system rotating about the central axis. The rotational force, applied by the rotation component, may decrease when the downhole tool is disconnected from the other tool. When the rotational force decreases to less than the bias component force, the bias component force of the one or more bias components of the lug system may be applied to the lug to return the lug back to a neutral position and additionally return the rotation component back to its respective neutral position.

In some implementations, the lug system may allow for the rotation component to rotate an allowable angle from the neutral position. In some implementations, one or more lug properties may be adjusted to adjust the angle for which the respective lug (and the rotation component coupled with the lug) may rotate from the neutral position. For example, a travel stop of a lug, the lug thickness, etc. may be adjusted to set the allowable angle of rotation for the respective lug and/or the amount of rotation the bias component may experience. For instance, a lug may be designed to rotate 36 degrees from a neutral position (i.e., the rotation component may rotate the lug 36 degrees from the neutral position). In some implementations, the lug system may include more than one lug if more rotation is required. For example, a lug system comprising 10 lugs, each configured to rotate 36 degrees, may allow for the rotation component to rotate 360 degrees from the neutral position. The addition of bias components in the lug system may allow the rotation component to perform its movement repeatedly without the lugs creating a limit. For example, the bias components may allow the rotation component to reset to a neutral position, allowing for repeatable orienting to be performed with or without a control line in place.

Example System

Figure 1B:
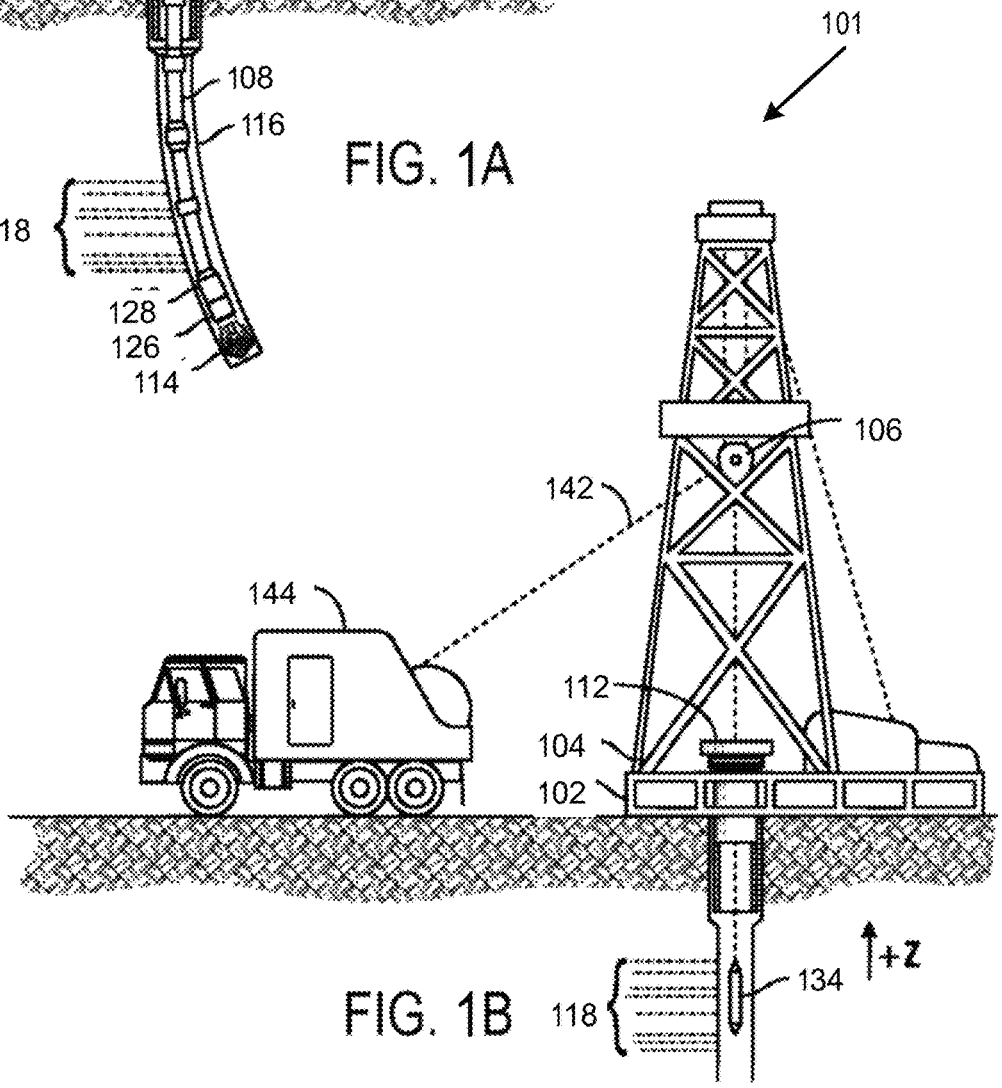

FIGS. 1A-1B are schematics of exemplary systems for a downhole tool, according to some implementations. FIG. 1A depicts an example drilling system 100. A drilling platform 102 supports a derrick 104 having a traveling block 106 for raising and lowering a drill string 108. A kelly 110 supports the drill string 108 as it is lowered through a rotary table 112. A drill bit 114 is driven by a downhole motor and/or rotation of the drill string 108. As the drill bit 114 rotates, it creates a wellbore 116 that passes through various subsurface formations 118. A pump 120 circulates drilling fluid through a feed pipe 122 to the kelly 110, downhole through the interior of the drill string 108, through orifices in the drill bit 114, back to the surface via the annulus around the drill string 108, and into a retention pit 124. The drilling fluid transports cuttings from the borehole into the retention pit 124 and aids in maintaining the borehole integrity.

A downhole tool 126 can be integrated into the bottom-hole assembly near the drill bit 114. In some implementations, the downhole tool 126 may include a lug system that may return one or more components on the bottom-hole assembly back to a neutral position if rotated about a central axis. For example, the lug system may include one or more lugs and one or more bias components that may allow a component on the bottom-hole assembly to rotate an allowable angle from its neutral position, and subsequently return the component to its neutral position via the bias components.

For purposes of communication, a downhole telemetry sub 128 can be included in the bottom-hole assembly to transfer measurement data to a surface receiver 130 and to receive commands from the surface. Mud pulse telemetry is one common telemetry technique for transferring tool measurements to surface receivers and receiving commands from the surface, but other telemetry techniques can also be used. In some embodiments, the downhole telemetry sub 128 can store logging data for later retrieval at the surface when the logging assembly is recovered.

At the surface, the surface receiver 130 can receive the uplink signal from the downhole telemetry sub 128 and can communicate the signal to a data acquisition module 132. The data acquisition module 132 can include one or more processors, storage mediums, input devices, output devices, software, etc. The data acquisition module 132 can collect, store, and/or process the data received from the bottom-hole assembly.

At various times during the drilling process, the drill string 108 may be removed from the wellbore 116 as shown in FIG. 1B. FIG. 1B depicts an example wireline system 101 with a wireline tool 134 positioned in the wellbore 116 after the drill string 108 is removed.

Once the drill string has been removed, logging operations can be conducted using a wireline tool 134 (i.e., a sensing instrument sonde suspended by a cable 142 having conductors for transporting power to the tool and telemetry from the tool to the surface). The wireline tool 134 may have pads and/or centralizing springs to maintain the tool near the central axis of the borehole or to bias the tool towards the borehole wall as the tool is moved downhole or uphole. The wireline tool 134 can also include one or more navigational packages for determining the position, inclination angle, horizontal angle, and rotational angle of the tool. Such navigational packages can include, for example, accelerometers, magnetometers, and/or sensors. In some embodiments, a surface measurement system (not shown) can be used to determine the depth of the wireline tool 134.

In some implementations, the wireline tool 134 may include components configured to connect to another tool positioned in the wellbore. For example, a tool may comprise downhole alignment orientation tool configured to rotate and align a fiber optic tool on the wireline tool 134 to connect to another tool (not shown) positioned in the wellbore. To avoid breaking and/or twisting the fiber optic cables of the fiber optic tool, the wireline tool 134 may also include a lug system configured to allow the downhole alignment orientation tool (and fiber optic tool) to rotate an allowable angle about its central axis. Additionally, the one or more bias components of the lug system may allow the fiber optic tool (and downhole alignment orientation tool) to reset to a neutral position so that the process of reorienting and reconnecting the fiber optic tool to the other tool may be repeated.

Although FIGS. 1A and 1B depict specific borehole configurations, it should be understood by those skilled in the art that the present disclosure is equally well suited for use in wellbores having other orientations including vertical wellbores, horizontal wellbores, slanted wellbores, multilateral wellbores and the like. Also, even though FIGS. 1A and 1B depict an onshore operation, it should be understood by those skilled in the art that the present disclosure is equally well suited for use in offshore operations. Moreover, it should be understood by those skilled in the art that the present disclosure is not limited to the environments depicted in FIGS. 1A and 1B, and can also be used, for example, in other well operations such as non-conductive production tubing operations, jointed tubing operations, coiled tubing operations, combinations thereof, and the like.

Example Lug System

Examples of a lug system are now described.

Figure 2B:
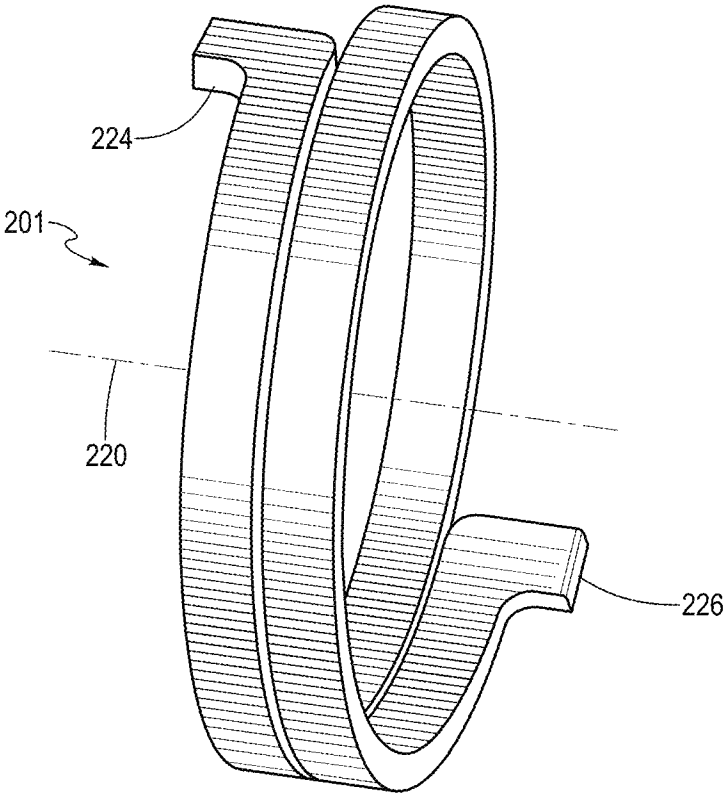
FIGS. 2A-2B are schematics of example lug system components, according to some implementations.
Figure 2A:
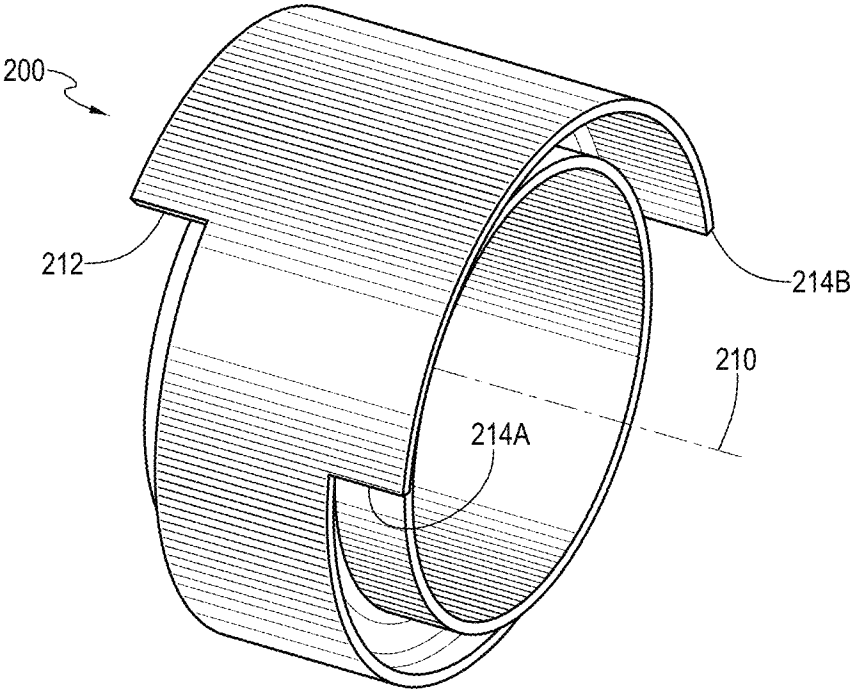

FIGS. 2A-2B are schematics of example lug system components, according to some implementations. FIG. 2A includes a schematic of a lug 200. The lug 200 may be configured to rotate about the central axis 210 when a rotational force is applied. For example, a component (such as another lug, a rotation component, etc.) may apply a rotational force to a face of the travel stop, such as travel stop face 212, travel stop face 214A, and/or or travel stop face 214B, to rotate the lug 200 about the central axis 210. Each of the travel stops faces 212, 214A, 214B may be configured to restrict the angle in which the lug 200 may rotate from a neutral position about the central axis 210. For example, the position of travel stop faces 214A and 214B may be azimuthally positioned on the respective end of the lug 200 to dictate the angle at which the lug 200 may rotate from the neutral position. In some implementations, other lug properties such as lug thickness may be altered to adjust the allowable angle of rotation of the lug 200. The lug 200 may be configured to rotate any suitable angle from the neutral position. For example, the lug 200 may be configured to rotate 10 degrees, 180 degrees, 360 degrees, etc.

FIG. 2B includes a schematic of a bias component 201. In particular, the bias component 201 depicts a torsional spring. In some implementations, the bias component 201 may include any one or more of a tension spring, compression spring, etc. In some implementations, the bias component properties such as shape, thickness, etc. may be altered for the design of the bias component 201. For example, one or more bias component properties may be adjusted to increase or decrease the bias component force of the bias component 201. The bias component 201 may rotate about the central axis 220. In some implementations, the central axis 220 may be the central axis 210 of the lug 200. The straights 224, 226 may be coupled with the lug 200 or another adjacent lug in a lug system such that the rotational force applied to the lug 200 may be transferred to the bias component 201. Alternatively, the bias component force generated by the bias component when rotated from its neutral position may be transferred to the lug 200 via the straights 224, 226. In some implementations, the straights 224, 226 may assist in controlling the angle the lug 200 is allowed to rotate. In some implementations, the lug 200 may be configured to rotate an angle from the neutral position based on the bias component force. For example, the lug 200 may be designed to rotate an angle from the neutral position such that the elastic limit of the bias component 201 is not exceeded.

Figure 3:
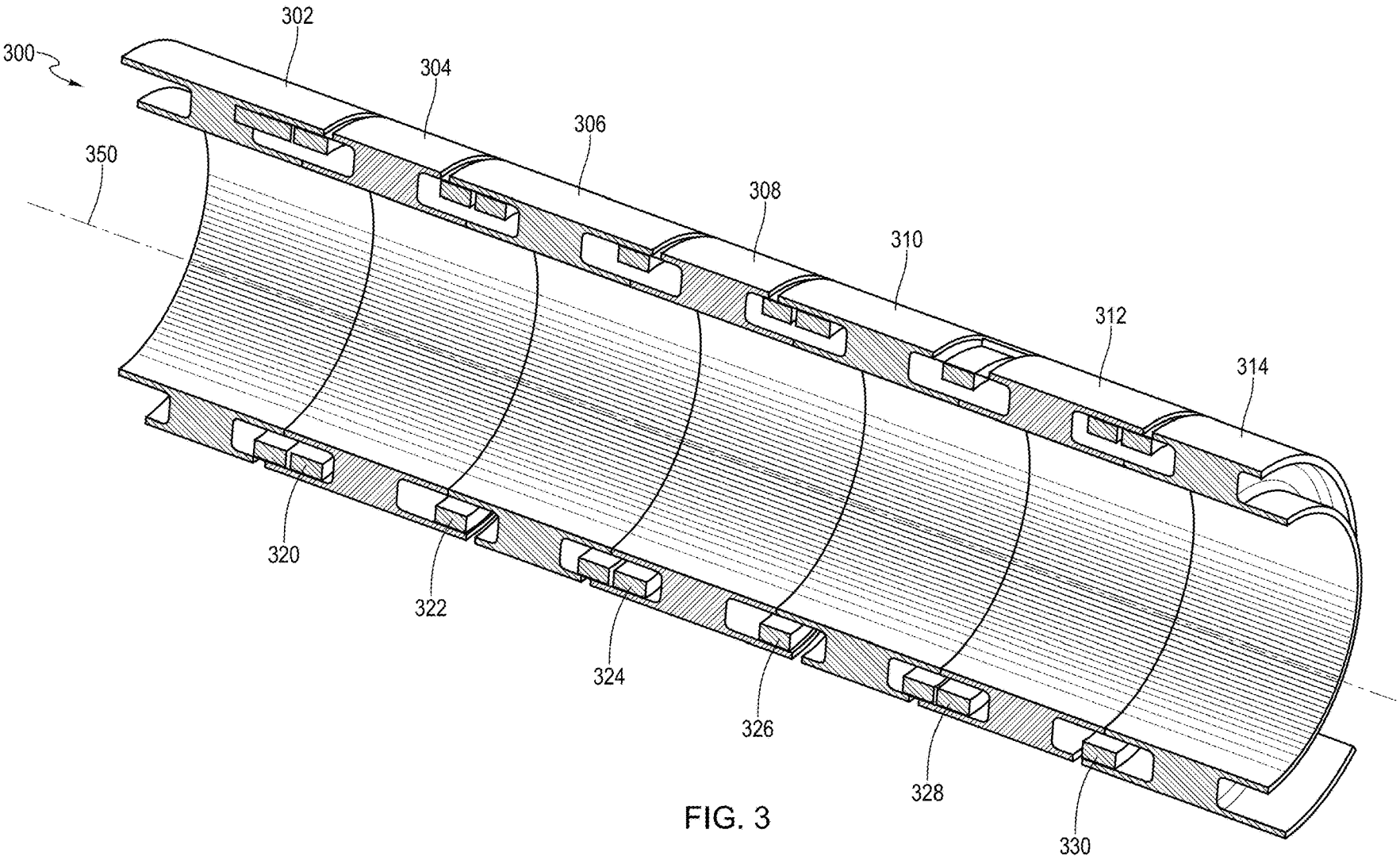
FIG. 3 is a schematic of an example lug system, according to some implementations.

FIG. 3 is a schematic of an example lug system, according to some implementations. In particular, FIG. 3 includes a cross-section schematic of a lug system 300 comprising lugs 302, 304, 306, 308, 310, 312, and 314. Each of the lugs 302-314 may be similar to the lug 200 of FIG. 2. Bias components 320, 322, 324, 326, 328, and 330 may be positioned in between the lugs 302-314. Each of the bias components 320-330 may be similar to the bias component 201 of FIG. 2. In some implementations, a rotational force may be applied to the lug system 300, resulting in the one or more of the lugs 302-314 rotating about the central axis 350. For example, the rotational force may be greater than the bias component force of one or more bias components such that the respective lug rotates about the central axis 350. Each of the lugs 302-314 may rotate independently, i.e., one or more lugs 302-314 may follow the path of least resistance. For example, when a rotational force is applied to the lug system 300, only one lug (e.g., lug 302) may rotate about the central axis 350, more than one lug may rotate, every lug may rotate, etc. In some implementations, when more than one lug rotates, the lugs may be adjacent to each other or not adjacent to each other. For example, lug 306 and lug 308 may rotate, or lug 306 and 312 may rotate and lugs 308 and 310 may remain stationary. In some implementations, each of the lugs 302-314 may be configured to rotate an angle from the neutral position (i.e., no rotational force is being applied to the lug system 300 and/or the bias component force of one or more bias components 320-330 is greater than a rotation force being applied to the lug system 300 resulting in the lug of the respective bias component remaining stationary). For example, each lug 302-314 may be configured to rotate 10 degrees. Thus, the total allowable rotation of the lug system may be 270 degrees (the sum of the allowable angle for each respective lug 302-314). Each lug 302-314 may be configured to rotate a similar or different angle than the other lugs. In some implementations, the rotation of each lug 302-314 may be unidirectional or bidirectional.

Each of the bias components 320-330 positioned in between the lugs 302-314 may apply a bias component force to the corresponding lug to return the lug back to a neutral position. For example, if lug 302 is rotated an angle from the neutral position, then bias component 320 may apply a bias component force to the lug 302 to return the lug 302 back to the neutral position once the rotational force is less than the bias component force of the bias component 320.

Figure 4:
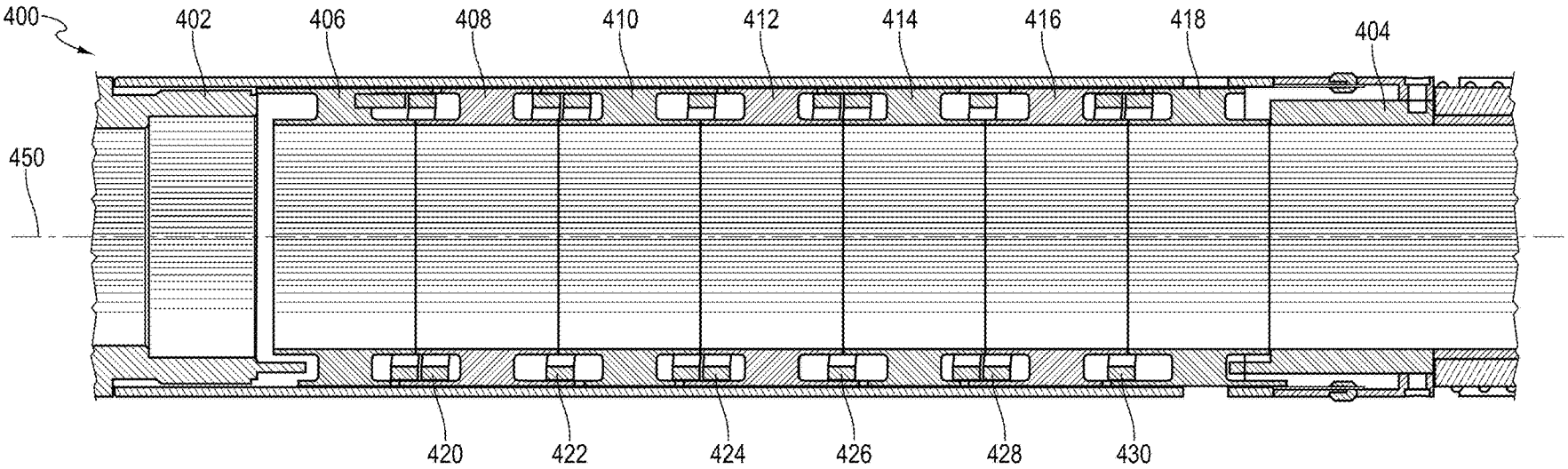
FIG. 4 is a schematic of an example lug system, according to some implementations.

FIG. 4 is a schematic of an example lug system, according to some implementations. In particular, FIG. 4 includes a cross-section schematic of a downhole tool 400 comprising a lug system, a fixed component 402, and a rotation component 404. The lug system may have similar components and function similarly to the lug system 300 of FIG. 3. For example, the lug system may include one or more lugs, such as lugs 406, 408, 410, 412, 414, 416, and 418, and one or more bias components positioned in between each of the lugs 406-418, such as bias components 420, 422, 424, 426, 428, and 430. The components of the downhole tool may be positioned along the central axis 450. A lug of the lug system may be coupled with a rotation component 404. The rotation component 404 may be configured to rotate about the central axis 450. For example, a component (not pictured) of the downhole tool 400 may be configured to rotate about the central axis 450, resulting in the rotation component 404 also rotating about the central axis 450. The rotational force from the rotation component 404 may be transferred to one or more of the lugs 406-418, resulting in one or more of the lugs 406-418 rotating about the central axis 450. The fixed component 402 may remain stationary with respect to the rotation of the lugs 406-418 to allow one of more of the lugs 406-418 to rotate. In some implementations, the top lug (i.e., lug 406) may act as the fixed component. When the rotation force applied by the rotation component 404 is less than the bias component force of the bias components 420-430, the bias components 420-430 will return the respective lug back to a neutral position.

Figure 5:
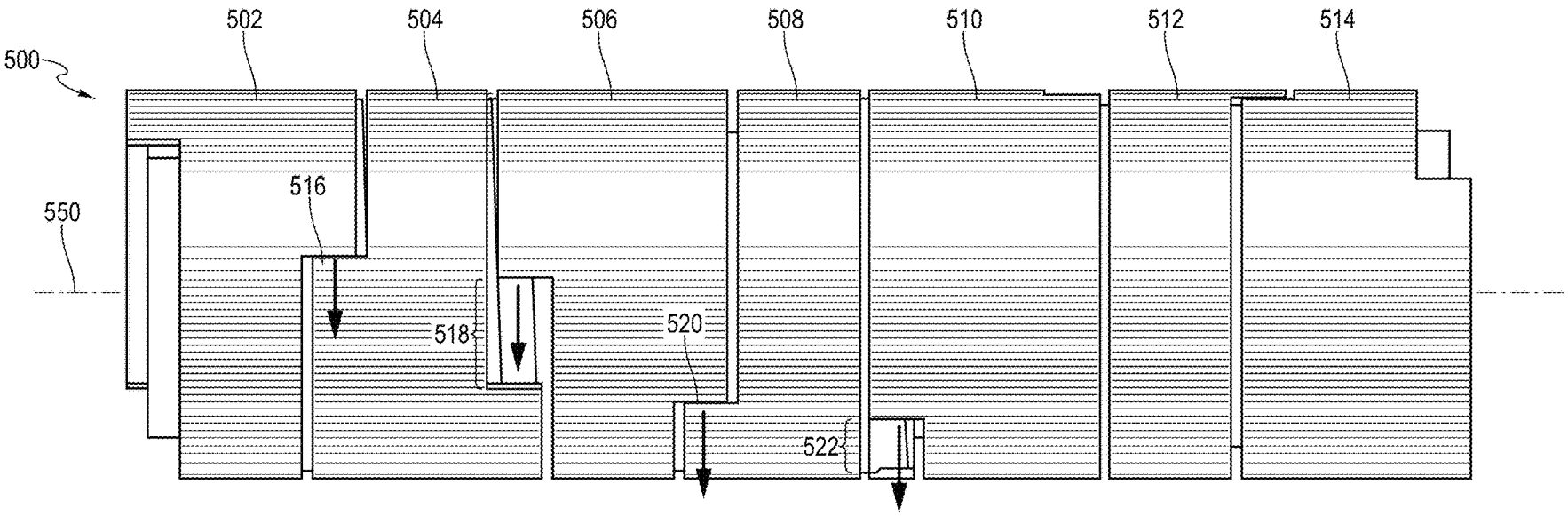
FIG. 5 is a schematic of an example lug system, according to some implementations.

FIG. 5 is a schematic of an example lug system, according to some implementations. In particular, FIG. 5 includes a schematic of a lug system 500 in operation. The lug system 500 may have a similar configuration and function to the lug system 300 of FIG. 3 and the lug system described in FIG. 4. For example, the lug system 500 includes lugs 502, 504, 506, 508, 510, 512, and 514. Each of the lugs 502-515 may be configured to rotate about a central axis 550. Each of the lugs 502-514 may be configured with a travel stop such that the travel stop for adjacent lugs may create a gap between the travel stop faces, such as gap 518 and gap 522. In some implementation, the gap between travel stop faces may be adjusted based on the bias component. For example, the gap may dictate the angle from the neutral position in which a lug may rotate. Accordingly, the gap may be adjusted such that it may rotate a given angle without exceeding the elastic limit of the respective bias component. For instance, is the bias component cannot strain when the straights of the bias component are rotated 36 degrees, the gap between the adjacent lugs for the respective bias component will be set so that the lugs cannot rotate more than 36 degrees from the neutral position.

If a gap between adjacent lugs is open prior to rotating, such as gaps 518 and gap 522, the gaps may close when the adjacent lugs are rotated. If a gap between adjacent lugs is closed prior to rotating, such as gaps 516 and gap 520, the gaps may close when the adjacent lugs are rotated. For example, when lug 504 is rotated, gap 516 may open and gap 518 may close. In some implementations, the gap distance between adjacent lugs may be similar or different to other gap distances between adjacent lugs. As many lugs as needed may be added or removed from the lug system to obtain the degrees of rotation required. When the rotation stops (i.e., the bias component force of the bias components is greater than the rotation force applied by a rotation component), then the lugs may return to the neutral position via the bias component force applied by the bias component. As a result, the lugs may rotate in the opposite direction, opening any gaps that were closed and closing any gaps that were open.

Figure 6:
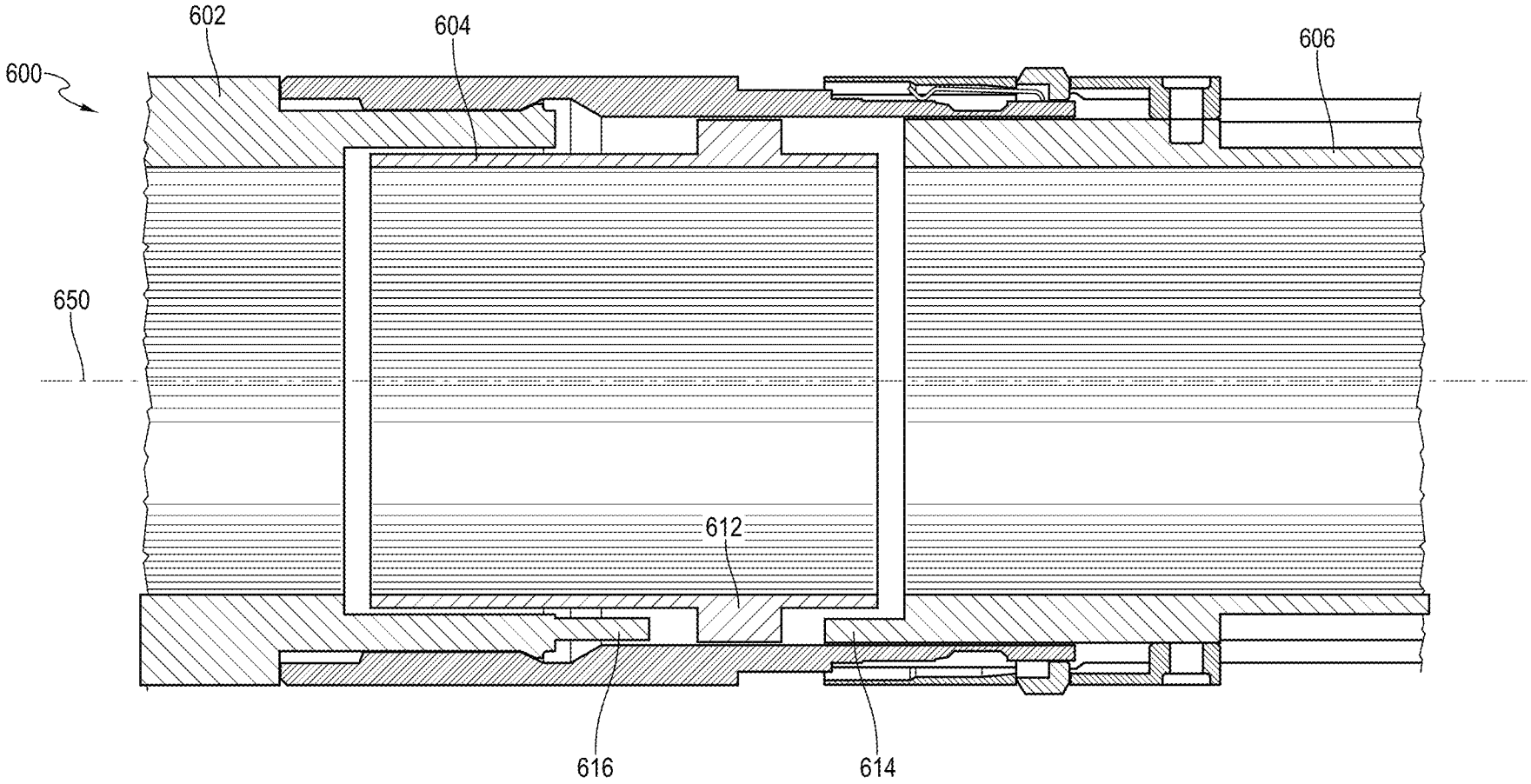
FIG. 6 is a schematic of an example single lug system, according to some implementations.

FIG. 6 is a schematic of an example single lug system, according to some implementations. In particular, FIG. 6 includes a downhole tool 600 comprising a fixed component 602, a lug 604, and a rotation component 606. The lug 604 is configured with a travel stop 612 such that when the rotation component 606 rotates (via another component (not pictured) on the downhole tool 600) about a central axis 650 of the downhole tool 600, the rotation force from the rotation component 606 may be transferred from a rotation component stop 614 to the travel stop 612. This may result in the lug 604 rotating about the central axis 650 until the travel stop 612 contacts the fixed component stop 616 of the fixed component 602. The fixed component 602 may be configured to not rotate about the central axis 650. The travel stop 612, fixed component stop 616, and rotation component stop 614 may be configured to adjust the angle from a neutral position the lug 604 may rotate. In some implementations, additional lugs may be added to increase the allowable angle of rotation of the rotation component 606.

Figure 7:
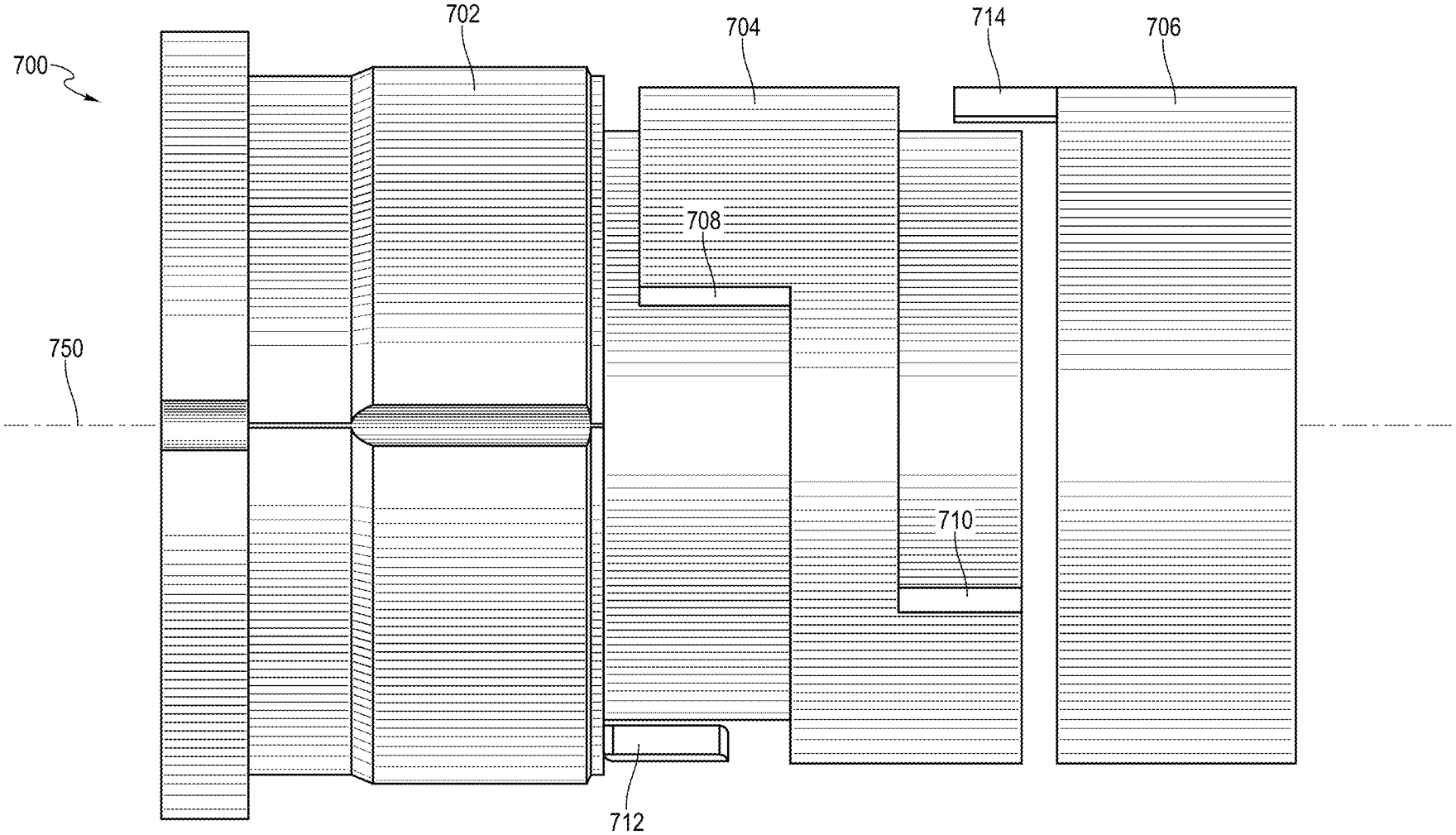
FIG. 7 is a schematic of an example bilateral lug system, according to some implementations.

FIG. 7 is a schematic of an example bilateral lug system, according to some implementations. In particular, FIG. 7 includes a downhole tool 700 comprising a fixed component 702, a bilateral lug 704, and a rotation component 706. The bilateral lug 704 is configured with a travel stop face 708 and travel stop face 710 such that when the rotation component 706 rotates (via another component (not pictured) on the downhole tool 700) about a central axis 750 of the downhole tool 700, the rotation force from the rotation component 706 may be transferred from a rotation component stop 714 to the travel stop face 710. This may result in the bilateral lug 704 rotating about the central axis 750 until the travel stop face 708 contacts the fixed component stop 712 of the fixed component 702. The travel stop faces 708, 710 may be configured such that the rotation component stop 714 may rotate past the fixed component stop 712 in both directions.

Figure 8:
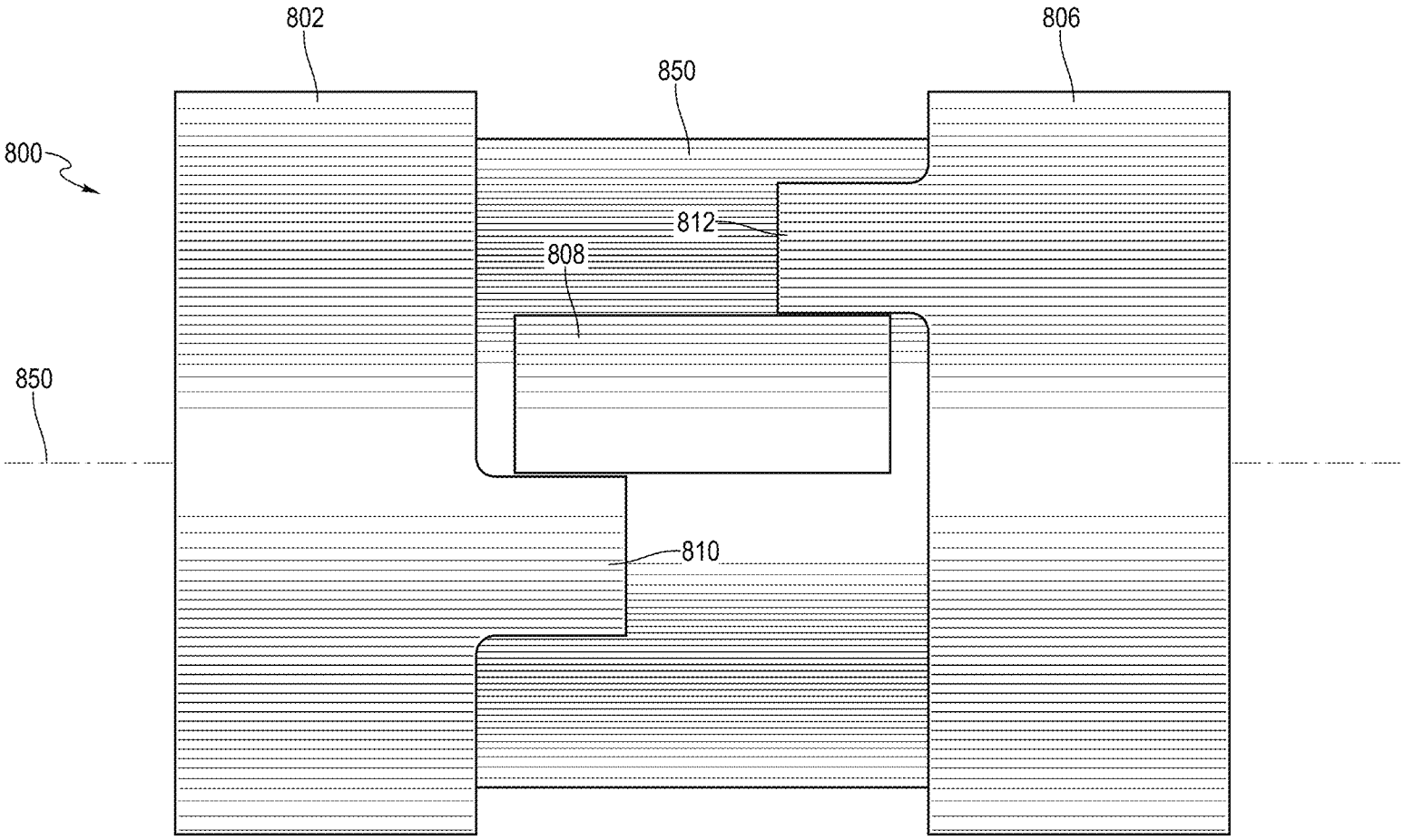
FIG. 8 is a schematic of an example unilateral lug system, according to some implementations.

FIG. 8 is a schematic of an example unilateral lug system, according to some implementations. In particular, FIG. 8 includes a downhole tool 800 comprising a fixed component 802, a unilateral lug 804, and a rotation component 806. The unilateral lug 804 is configured with a travel stop 808 such that when the rotation component 806 rotates (via another component (not pictured) on the downhole tool 800) about a central axis 850 of the downhole tool 800, the rotation force from the rotation component 806 may be transferred from a rotation component stop 814 to the travel stop 808. This may result in the unilateral lug 804 rotating about the central axis 850 until the travel stop 808 contacts the fixed component stop 810 of the fixed component 802. The fixed component 602 is configured to not rotate about the central axis 850. In some implementations, the travel stop 808 may be configured to only allow the rotation component 806 to rotate in one direction. In some implementations, additional lugs may be added to the lug system to obtain more degrees of freedom.

Example Operations

Example operations for operating or controlling a downhole tool to obtain fluid samples are now described in reference to FIGS. 1-8.

Figure 9:
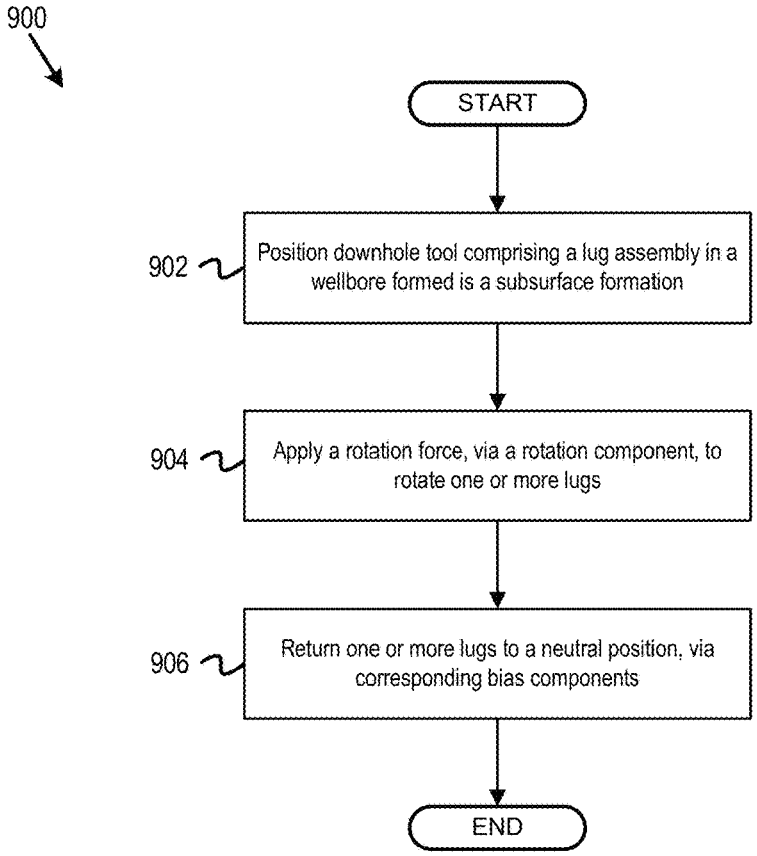
FIG. 9 is a flowchart depicting example operations for operating a lug system, according to some implementations.

FIG. 9 is a flowchart depicting example operations for operating a lug system, according to some implementations. FIG. 9 depicts a flowchart 900 of operations to return a downhole tool to a neutral position. The operations of the flowchart 900 are described in reference to the lug assemblies described in FIGS. 2-8.

At block 902, a downhole tool comprising a lug assembly may be positioned in a wellbore formed in a subsurface formation. The lug assembly may include one or more lugs, each of the lugs configured to rotate an angle from a neutral position about the central axis of the downhole tool. The lug assembly may also include one or more bias components for each respective lug. Each bias component may be configured to return the corresponding lug to the neutral position. In some implementations, the angle at which each lug may rotate may be based on the corresponding bias component. The downhole tool may also include a rotation component coupled with the lug system and configured to rotate about the central axis.

At block 904, a rotation force may be applied, via a rotation component, to rotate the one or more lugs. The downhole tool may be configured to apply the rotation force to the one or more lugs. For example, a force may be applied to the downhole tool to connect the downhole tool to another tool in the wellbore. The force may result in a mechanical interface of the downhole tool rotating the rotation component and ultimately rotating the one or more lugs. Any other suitable configuration of the downhole tool may be utilized to apply a rotation force to the rotation component to rotate one or more lugs about the central axis. In some implementations, the bias component force of the bias assembly for the corresponding lug may be less than the rotation force, allowing the respective lug to rotate.

At block 906, one or more lugs may return to a neutral position, via corresponding bias components. Once the rotation force is less than the bias component force, the bias component may return the corresponding lug back to the neutral position (i.e., the position prior to when the rotational force became greater than the bias component force to rotate the lug).

Example Embodiments

Implementation #1: An apparatus to be positioned in a wellbore formed in a subsurface formation, the apparatus comprising: a first lug coupled with a rotation component and configured to rotate a first angle from a neutral position about a central axis when a rotational force is applied to the first lug via the rotation component; and a first bias component coupled with the first lug and configured to return the first lug to the neutral position when the first lug is rotated about the central axis.

Implementation #2: The apparatus of Implementation #1 further comprising: a fixed component that cannot rotate about the central axis, wherein the first lug is coupled with the fixed component.

Implementation #3: The apparatus of Implementation #1 or 2, wherein the rotational force is greater than a bias force of the first bias component.

Implementation #4: The apparatus of any one of more of Implementations #1-3, wherein the first bias component includes one or more torsion spring, compression spring, and tension spring.

Implementation #5: The apparatus of any one of more of Implementations #1-4 further comprising: a second lug coupled with the first lug, wherein the second lug is configured to rotate, via the rotation component, a second angle from the neutral position of the second lug about the central axis; and a second bias component coupled with the second lug and configured to return the second lug to the neutral position of the respective second lug.

Implementation #6: The apparatus of Implementation #5, wherein the first lug and the second lug rotate independently when the rotation component generates the rotational force.

Implementation #7: The apparatus of Implementation #5 or 6, wherein an allowable angle of rotation of the rotation component from the neutral position is based on the first angle of the first lug and the second angle of the second lug.

Implementation #8: The apparatus of any one of more of Implementations #1-7, wherein the first angle of the first lug is based one on one or more lug properties including travel stop size and lug thickness.

Implementation #9: The apparatus of any one of more of Implementations #1-8, wherein the rotation of the first lug is unidirectional or bidirectional.

Implementation #10: A downhole tool to be positioned in a wellbore formed in a subsurface formation, the downhole tool comprising: a rotational component configured to generate a rotational force; a first lug coupled with the rotation component and configured to rotate a first angle from a neutral position about a central axis when the rotational force is applied to the first lug via the rotation component; and a first bias component coupled with the first lug and configured to return the first lug to the neutral position when the first lug is rotated about the central axis.

Implementation #11: The downhole tool of Implementation #10 further comprising: a fixed component that cannot rotate about the central axis, wherein the first lug is coupled with the fixed component.

Implementation #12: The downhole tool of Implementation #10 or 11, wherein the rotational force is greater than a bias force of the first bias component.

Implementation #13: The downhole tool of any one of more of Implementations #10-12, wherein the first bias component includes one or more torsion spring, compression spring, and tension spring.

Implementation #14: The downhole tool of any one of more of Implementations #10-13 further comprising: a second lug coupled with the first lug, wherein the second lug is configured to rotate, via the rotation component, a second angle from the neutral position of the second lug about the central axis; and a second bias component coupled with the second lug and configured to return the second lug to the neutral position of the respective second lug.

Implementation #15: The downhole tool of Implementation #14, wherein the first lug and the second lug rotate independently when the rotation component generates the rotational force.

Implementation #16: The downhole tool of Implementation #14 or 15, wherein an allowable angle of rotation of the rotation component from the neutral position is based on the first angle of the first lug and the second angle of the second lug.

Implementation #17: The downhole tool of any one of more of Implementations #10-16, wherein the rotation of the first lug is unidirectional or bidirectional.

Implementation #18: A method comprising: positioning a downhole tool in a wellbore formed in a subsurface formation, wherein the downhole tool includes a lug system configured with a first lug and a first bias component; applying a rotation force, via a rotation component, to rotate the first lug a first angle from a neutral position about a central axis of the downhole tool; and returning the first lug to the neutral position via the first bias component.

Implementation #19: The method of Implementation #18, wherein the rotational force is greater than a bias force of the first bias component.

Implementation #20: The method of Implementation #18 or 19, wherein the first bias component includes one or more torsion spring, compression spring, and tension spring.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. An apparatus to be positioned in a wellbore formed in a subsurface formation, the apparatus comprising:

a first lug configured with a first travel stop face to directly contact a solid rotational component, wherein the first lug is configured to rotate a first angle from a neutral position about a central axis in response to the solid rotational component directly contacting the first travel stop face to apply a rotational force to the first travel stop face, and wherein the first travel stop face of first lug does not directly contact the solid rotational component when in the neutral position; and a first bias component coupled with the first lug and configured to return the first lug to the neutral position when the first lug is rotated about the central axis.

2. The apparatus of claim 1 further comprising:

a fixed component that cannot rotate about the central axis relative to the first lug, wherein the first lug is coupled with the fixed component.

3. The apparatus of claim 1, wherein the rotational force is greater than a bias force of the first bias component.

4. The apparatus of claim 1, wherein the first bias component includes a torsion spring.

5. The apparatus of claim 1 further comprising:

a second lug coupled with the first lug, wherein the second lug is configured to rotate, via the solid rotational component, a second angle from the neutral position of the second lug about the central axis; and a second bias component coupled with the second lug and configured to return the second lug to the neutral position of the respective second lug.

6. The apparatus of claim 5, wherein the first lug and the second lug rotate independently when the solid rotational component generates the rotational force.

7. The apparatus of claim 5, wherein an allowable angle of rotation of the solid rotational component from the neutral position is based on the first angle of the first lug and the second angle of the second lug.

8. The apparatus of claim 1, wherein the first angle from the neutral position about the central axis is based on one or more lug properties of the first lug including travel stop size and lug thickness.

9. The apparatus of claim 1, wherein the rotation of the first lug is unidirectional or bidirectional.

10. A downhole tool to be positioned in a wellbore formed in a subsurface formation, the downhole tool comprising:

a solid rotational component configured to generate a rotational force;

a first lug configured to rotate a first angle from a neutral position about a central axis when the solid rotational component directly contacts a first travel stop face of the first lug to apply the rotational force to the first lug via the solid rotational component, wherein the first travel stop face of first lug does not directly contact the solid rotational component when in the neutral position; and a first bias component coupled with the first lug and configured to return the first lug to the neutral position when the first lug is rotated about the central axis.

11. The downhole tool of claim 10 further comprising:

a fixed component that cannot rotate about the central axis relative to the first lug, wherein the first lug is coupled with the fixed component.

12. The downhole tool of claim 10, wherein the rotational force is greater than a bias force of the first bias component.

13. The downhole tool of claim 10, wherein the first bias component includes a torsion spring.

14. The downhole tool of claim 10 further comprising:

a second lug coupled with the first lug, wherein the second lug is configured to rotate, via the solid rotational component, a second angle from the neutral position of the second lug about the central axis; and a second bias component coupled with the second lug and configured to return the second lug to the neutral position of the respective second lug.

15. The downhole tool of claim 14, wherein the first lug and the second lug rotate independently when the solid rotational component generates the rotational force.

16. The downhole tool of claim 14, wherein an allowable angle of rotation of the solid rotational component from the neutral position is based on the first angle of the first lug and the second angle of the second lug.

17. The downhole tool of claim 10, wherein the rotation of the first lug is unidirectional or bidirectional.

18. A method comprising:

positioning a downhole tool in a wellbore formed in a subsurface formation, wherein the downhole tool includes a lug system configured with a first lug, a solid rotational component, and a first bias component;

applying a rotation force to a first travel stop face of the first lug, via the solid rotational component directly contacting the first lug, to rotate the first lug a first angle from a neutral position about a central axis of the downhole tool, wherein the first travel stop face of first lug does not directly contact the solid rotational component when in the neutral position; and returning the first lug to the neutral position via the first bias component.

19. The method of claim 18, wherein the rotational force is greater than a bias force of the first bias component.

20. The method of claim 18, wherein the first bias component includes a torsion spring.

* * * * *